US005518217A

United States Patent [19]

Deutsch et al.

[11] Patent Number: 5,518,217

[45] Date of Patent: May 21, 1996

[54] STACKABLE PRESENTATION BOARD WITH COLLAPSIBLE LEGS AND PAD HOLDER

[75] Inventors: Dennis Deutsch, Hastings; Jeffrey S. Brower, Marine on St. Croix, both of Minn.; Lindsay A. Brown, Mission Viejo, Calif.

[73] Assignee: Pierce Companies, Inc., Santa Ana, Calif.

[21] Appl. No.: 273,660

[22] Filed: Jul. 12, 1994

[51] Int. Cl.[6] ..... A47B 97/04

[52] U.S. Cl. ..... 248/463; 248/452; 248/461

[58] Field of Search ..... 248/441.1, 450, 248/452, 455, 456, 457, 460, 461, 463, 464, 465; 211/45, 89; 434/408

[56] References Cited

U.S. PATENT DOCUMENTS

| | | | |
|---|---|---|---|
| 2,309,876 | 2/1943 | Todd . | |
| 2,953,341 | 9/1960 | Howell | 248/464 |
| 3,058,706 | 10/1962 | Snell | 248/464 X |
| 3,294,251 | 12/1966 | Howell . | |
| 3,295,815 | 1/1967 | Howell | 248/464 |
| 3,297,118 | 1/1967 | Van Skyhawk et al. . | |
| 3,360,226 | 12/1967 | Nicholas . | |
| 3,608,221 | 9/1971 | Harris . | |
| 4,300,300 | 11/1981 | Neuland et al. . | |
| 4,544,123 | 10/1985 | Peacock . | |
| 4,555,084 | 11/1985 | Anderson et al. | 248/460 |
| 4,684,028 | 8/1987 | Reppel | 248/452 X |
| 4,826,124 | 5/1989 | Kindig | 248/452 |
| 5,095,642 | 3/1992 | George et al. . | |
| 5,125,613 | 6/1992 | Albee, Jr. et al. | 248/463 X |
| 5,205,526 | 4/1993 | Deutsch | 248/452 X |
| 5,366,197 | 11/1994 | Westland | 248/452 X |

FOREIGN PATENT DOCUMENTS

| | | | |
|---|---|---|---|
| 755740 | 8/1956 | United Kingdom | 248/463 |

*Primary Examiner*—Ramon O. Ramirez
*Assistant Examiner*—Derek J. Berger
*Attorney, Agent, or Firm*—Price, Gess & Ubell

[57] ABSTRACT

A novel presentation board has a body of molded plastic which forms a strong, hollow, lightweight unit with a projecting tray and grip on a front surface and a corresponding recesses on a rear surface so the units can be conveniently stacked. The front surface of the body bears an extruded track for insertion and replacement of a whiteboard or other writing surface. The whiteboard is secured at a top edge of the body by two metal pegs, sized and spaced apart to accept a prepunched pad of flip chart paper, that pass through the whiteboard into threaded inserts in the plastic body. The grip protrudes from a top edge of the whiteboard and is slidably mounted on the pegs. When slid into a lower position, the grip hides the pegs and locks the pad in position. A pair of U-shaped tubular metal legs can be slid into channels in a rear surface of the body. The channels are covered, at all but part of their lower ends, by cover plates. Grasping the lower leg ends allows one to slide the legs from the unit. One leg slides straight down remaining in the plane of the board. A second leg slides part of the way down and then is automatically pivoted to the rear by torsion springs, thereby forming a convenient prop to elevate the board.

21 Claims, 4 Drawing Sheets

STACKABLE PRESENTATION BOARD WITH COLLAPSIBLE LEGS AND PAD HOLDER

BACKGROUND OF THE INVENTION

1. Field of the Invention

The present invention is directed towards displaying written charts and graphics for classes, seminars, business meetings and the like and, more specifically, to an improved presentation board that has special provisions for holding a pad of paper, has collapsible legs, and is stackable when collapsed.

2. Description of Related Art

The presentation of graphics and written materials for teaching and for business and other meetings has undergone considerable development in recent years. In the beginning there was the ubiquitous blackboard or slate. At one time the boards were actually black and were written on with sticks of chalk. Today, the board is usually white (or beige) and is written on with special felt markers. The "whiteboard" provides erasable information that is large enough to be seen by an audience and can be presented interactively. That is, material is added or subtracted from the board as a lecturer speaks or in response to a question from the audience.

Thus, a blackboard system remains a key part for presentations and teaching. There is no problem if the teaching activity occurs in a classroom, because virtually all classrooms have some type of blackboard permanently installed. However, if a presentation is made in a conference room or office, a permanently installed blackboard is usually not available. Therefore, presentation boards have been developed. Basically, such devices contain a whiteboard of convenient dimensions for easy transport. The unit is equipped with legs to elevate the board for convenient viewing. Preferably the legs can be folded or broken down in some manner so that the presentation board is reduced to a package that can readily carried from room to room or building to building and then rapidly set up for a seminar or some similar gathering.

U.S. Pat. No. 3,249,251 to Howell discloses a portable display rack. This unit is supported by four tubular legs formed as two U-shaped members. These legs fold out from a rear surface of the rack to assemble the unit. However, while the legs do fold flat for carrying purposes, the legs remain full length, extending beyond the perimeters of the rack even in a disassembled state. Therefore, the legs may catch on items and render transporting the rack inconvenient.

U.S. Pat. No. 3,297,188 to Skyhawk et al. teaches a combined carrying and display case for visual aids used in seminars and teaching. This device folds into a convenient carrying package which holds items and then unfolds into a display holder. The unit, as described, is too small for a presentation board. When the case is opened, a carrying handle forms a front leg while half the case forms a rear leg. Both of the legs are angled from the case so that the effective elevation is less than a longest dimension of the case. If the device were scaled up to presentation board size, the leg configuration would produce a board that was too low by conventional standards since the elevation of the board is usually at least equal to a longest dimension of the board, thereby elevating a lower edge of the board to about waist height.

U.S. Pat. No. 4,300,300 to Neuland et al. discloses a simple portable display board which is supported by three legs of a configuration much like an artist's easel. That is, two front legs are in the plane of the board, while the third leg pivots back from an upper end of the display board to create a stable tripod. The portability of the unit is improved by having the front legs slide up into the board while the rear leg folds flat on a rear surface of the board and telescopes in length so that the folded rear leg is no longer than the board. However, the folded rear leg is present on the rear surface where it can catch on items during transport and interfere with flat stacking of the display boards.

A major problem with all blackboard systems is their limited writing space. This means that sooner or later a board user will be forced to erase part of the board and will be unable to refer again to the erased information. Also, it is very difficult to prepare a presentation in advance-one cannot bring in prepared sections of blackboard. This problem is exacerbated with a presentation board since the board is generally much smaller than the permanently installed boards of a classroom.

One solution is to include a means for holding paper sheets as in a flip chart. In its simplest form, the flip chart is merely a very large pad of paper. The lecturer uses felt markers or crayons to illustrate points. The flip chart is used like a blackboard, but the usual flip chart is not erasable. Instead, a new sheet of paper is revealed by tearing off the original sheet or by flipping it over the top of the pad.

There are at least two advantages to the flip chart. First, it is quite simple to prepare much or all of the material in advance. Furthermore, the charts are usually small enough to be readily carried from place to place. Second, the chart is permanent so that sheets can be referred to repeatedly and even saved as a record of the presentation. One effective technique is to ask the audience questions as one writes on the chart. Audience consensus is then recorded on the chart. As ideas are developed, the key charts can be torn from the pad and taped or hung about the room so that they are always available for instant reference. Thus, there is a need for a system that can easily accommodate an erasable board and a flip chart.

OBJECTS AND SUMMARY OF THE INVENTION

It is an object of the present invention to provide a whiteboard presentation board that is light in weight so it can be easily transported;

It is a further object of the present invention to provide a lightweight presentation board with legs that easily collapse into the board for ready transport;

It is another object of the present invention to provide a lightweight, collapsible presentation board with collapsible legs that is very simple to assemble or disassemble;

It is further object of the present invention to provide a lightweight collapsible presentation board that readily accommodates a pad of prepunched flip chart paper;

It is a still further object of the present invention to provide a lightweight collapsible presentation board which is readily stackable when collapsed; and It is as additional object of the present invention to provide a lightweight collapsible presentation board that allows easy replacement of a whiteboard.

These and additional objects are met by a presentation board in which a main body of the board is molded of plastic and forms a strong, hollow, lightweight unit. The body is molded with a projecting tray on a front surface and a corresponding niche on a rear surface so the units can be conveniently stacked. The front surface of the body bears an aluminum track into which is slid a whiteboard or similar writing surface which can be readily replaced as needed. At a top edge of the unit the whiteboard is secured by two metal pegs that pass through the whiteboard into threaded inserts in the plastic body. The pegs are sized and spaced apart to accept a prepunched pad of flip chart paper. An extruded grip forms a top edge of the whiteboard and is slidably mounted on the pegs. When slid into a lower position the grip hides the pegs and locks the pad. The board is supported by a pair of U-shaped tubular metal leg members which can be collapsed into leg channels on a rear surface of the body. The channels are covered, at all but their lower ends, by leg cover plates. Grasping lower ends of the leg members allows one to slide the leg members from the unit. One leg member slides straight down, remaining in the plane of the board. A second leg slides part of the way down and then is automatically pivoted to the rear by torsion springs, thereby forming a convenient prop to support the board elevated on the leg members.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a lightweight collapsible presentation board with a flip chart holder.

Figure 2:
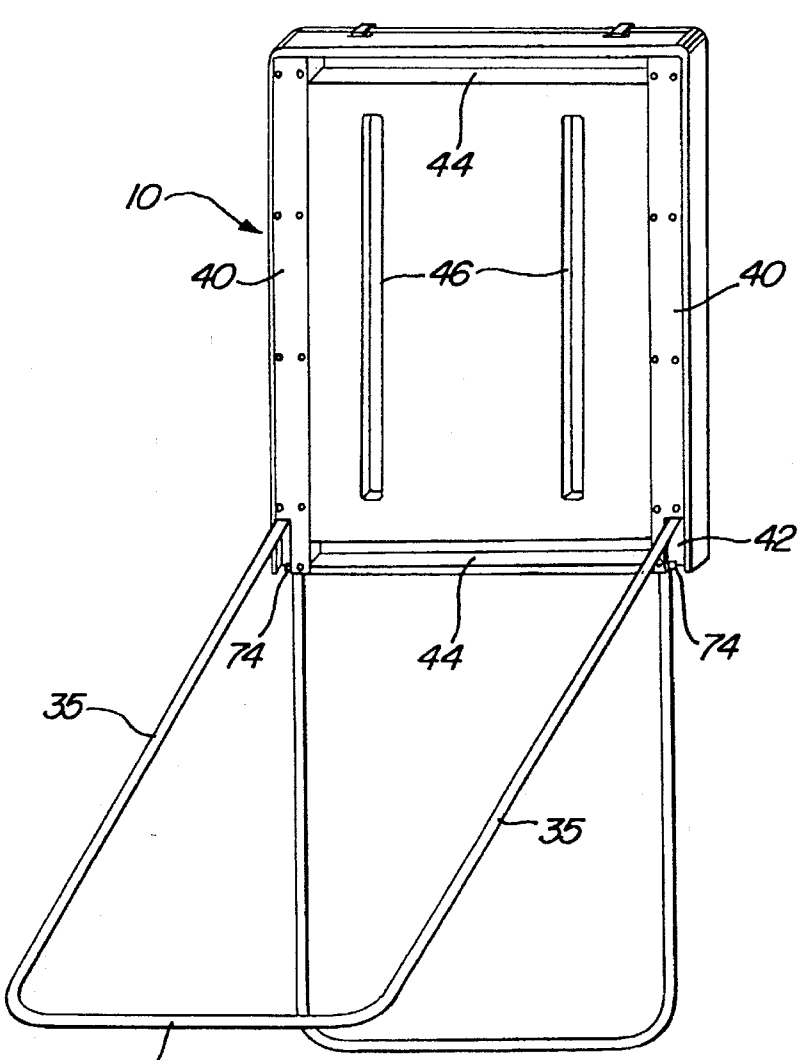
FIG. 2 shows a rear perspective view of the presentation board of FIG. 1.
Figure 1:
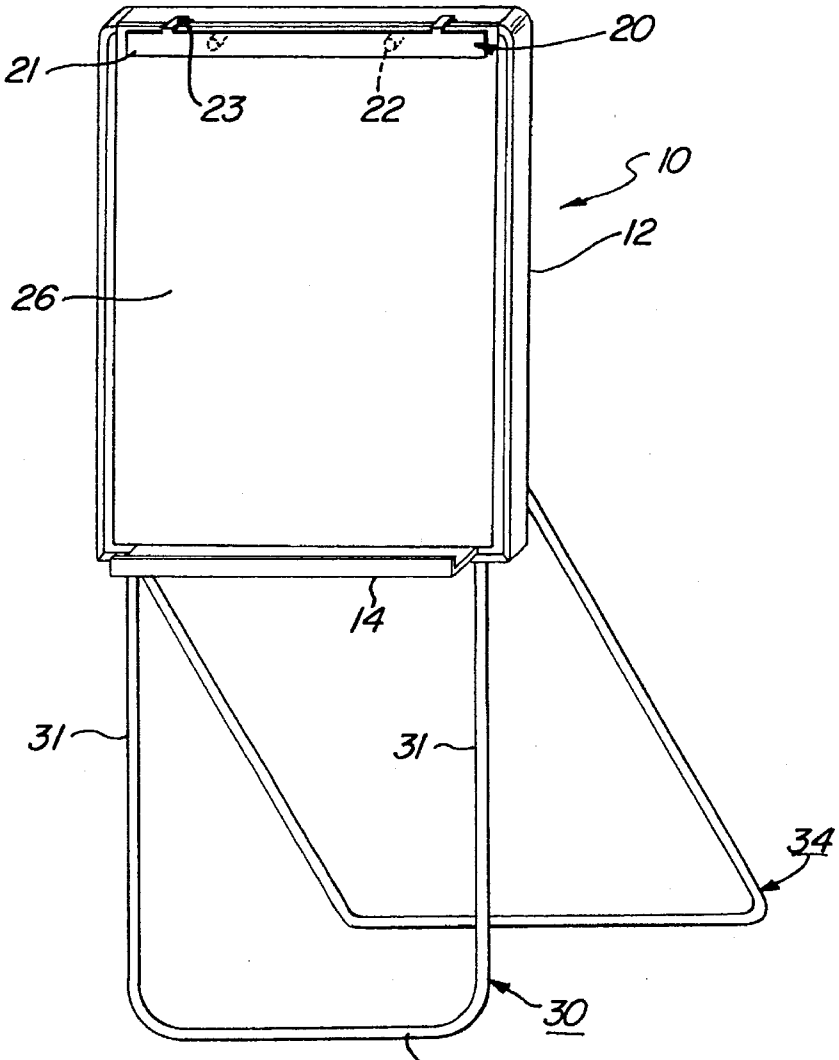
FIG. 1 shows a front perspective view of a presentation board of the present invention with legs extended.

A perspective view of a front surface of a presentation board 10 of the preferred embodiment is shown in FIG. 1, while a view of a rear surface of the presentation board 10 is shown in FIG. 2. The board 10 comprises a rectangular board body 12 that has a tray 14 protruding from near a lower edge. A grip 20 protrudes near an upper edge of the front surface. As shown in dotted line, the grip 20 conceals two pegs 22 which are sized and spaced apart to receive the holes of a prepunched flip chart pad 28. The front surface also bears a whiteboard surface 26 which is a surface of a ⅛-inch-thick board which is retained by rail channels 80 which are attached to the board body 12 by a barb 82 (see FIG. 8). This arrangement makes it easy to replace a damaged whiteboard or to exchange the normal board for one with a magnetic or other special surface.

Figure 3:
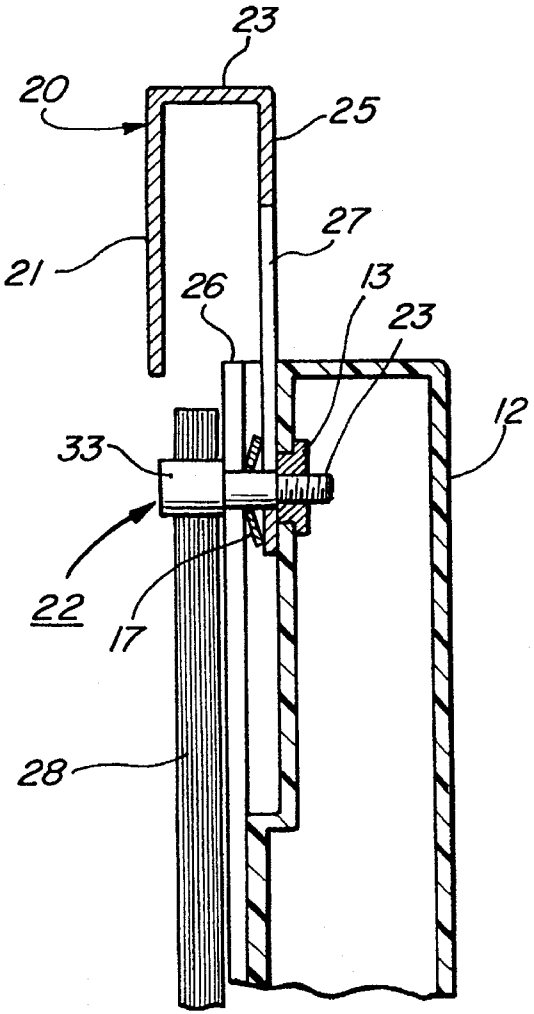
FIG. 3 shows a diagrammatic cross-section of a grip and peg closure system of the present invention in an open configuration.

As shown in FIG. 3, the grip 20 and pegs 22 comprise a closure system for the flip chart, as well as a retention system for the whiteboard 26. Each peg 22 is threaded at a first end 23 to engage a threaded insert 13 molded into the board body 12. A diameter of the peg 22 at a second end 33 is larger and designed to accept prepunched sheets of the flip chart pad 28. The pegs 22 pass through holes in the whiteboard 26, through a curved spring washer 17, and through a slot 27 in a rear portion of the grip 20 before reaching the insert embedded in the board body. Thus, the pegs 22 fix the whiteboard 26 in place. The spring washer 17 between the white board 26 and the grip 20 provide friction to keep the grip 20 in an opened or closed position.

Figure 4:
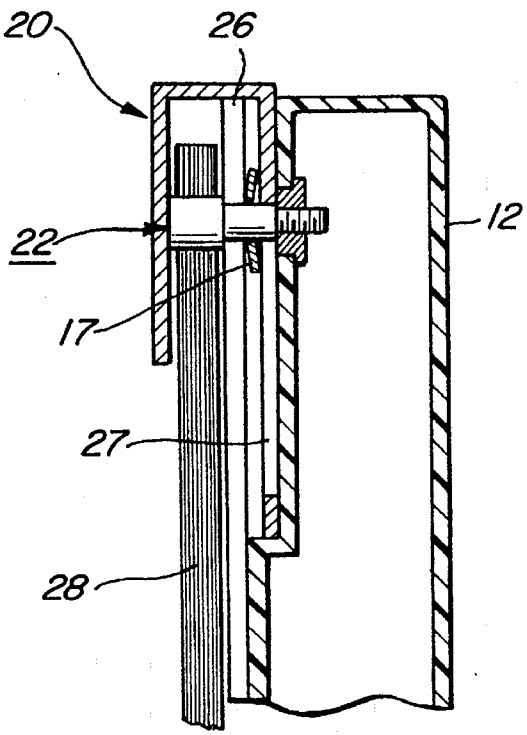
FIG. 4 shows a diagrammatic cross-section of a grip and peg closure system of the present invention in a closed configuration.

The grip 20 is open in FIG. 3 so that the pad 28 can be exchanged or the pegs 22 can be unscrewed to release the grip 20 and the whiteboard 26. The grip 20 is a single extrusion comprising a front portion 21, a top portion 23, and a rear portion 25, with the front portion 21 and rear portion 25 being parallel and the top portion 23 being perpendicular to the other portions. Pressing down on the grip 20 causes the slots 27 to slide relative to the peg 22 and close the grip 20 (FIG. 4). This locks the pad 28 into the grip 20. As the sheets of the flip chart pad 28 are used, they can be flipped over the rear of the board 10 or readily torn off, with a lower edge of the front portion 21 of the grip 20 acting as a tear edge. Pulling the grip 20 in an upwards direction will return it to the open position.

Figure 8:
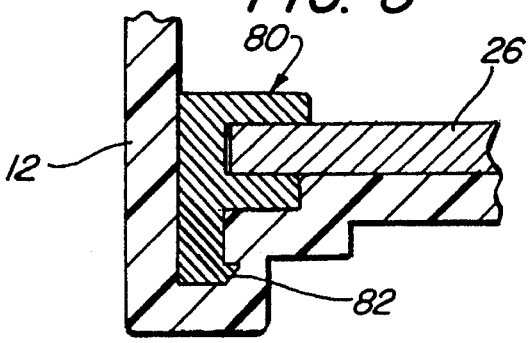
FIG. 8 is a cross-section of a front surface of the invention showing a rail system to retain a whiteboard.

The entire board body 12 is a single piece of rotationally-molded plastic. The body is hollow with ⅛-thick walls of polyethylene or other moldable plastic for maximum strength and minimum weight. Threaded metal inserts are molded into the board body for maximum reliability of screws and attached hardware such as the metal pegs 22. FIG. 8 shows that the retaining rails 80 for the whiteboard surface 26 are aluminum extrusions bearing a barb 82 allowing them to be permanently retained by channels molded into the board body 12. The grip 20 is also an aluminum extrusion.

In FIG. 1 two metal leg members, a front leg member 30, and a rear leg member 34, are visible descending from a lower part of the board body 12. Each leg member is tubular and substantially U-shaped. Two upright portions of the front leg member 30 constitute two front legs 31 which are joined by a bottom portion 32 of the U-shaped leg member 30. The front legs 31 are parallel to a longitudinal axis of the board body and are in essentially the same plane as the planar board body 12.

FIG. 2 is a view of a rear surface of the presentation board. Metal leg cover plates 40 conceal leg channels 50 (see FIG. 5) into which the leg members 30, 34 can be slid. Two upright portions of the rear leg member 34 constitute rear legs 35 which project at an angle from a rear surface of the body board 12. The entire presentation board leans backwards to rest on the flat bottom portion 36 of the rear leg member 34.

The departure of the rear legs 35 from the plane of the board body 12 is allowed by cutouts 42 in the leg cover plates 40. The cutouts 42 are only wide enough for the rear legs 35. The leg cover plates 40 are continuous over the front legs 31, ensuring that the front legs 31 remain parallel to the longitudinal axis of the board body 12.

The rear surface of the board body 12 also bear recesses 44 sized to fit the tray 14 and the grip 20 which project from the front surface. Thus, the units are readily stackable with the tray 14 and the grip 20 of one unit fitting the recesses 44 of the next unit. The rear surface also bears strengthening ribs 46 which may also serve as handles for carrying the board 10.

Figure 5:
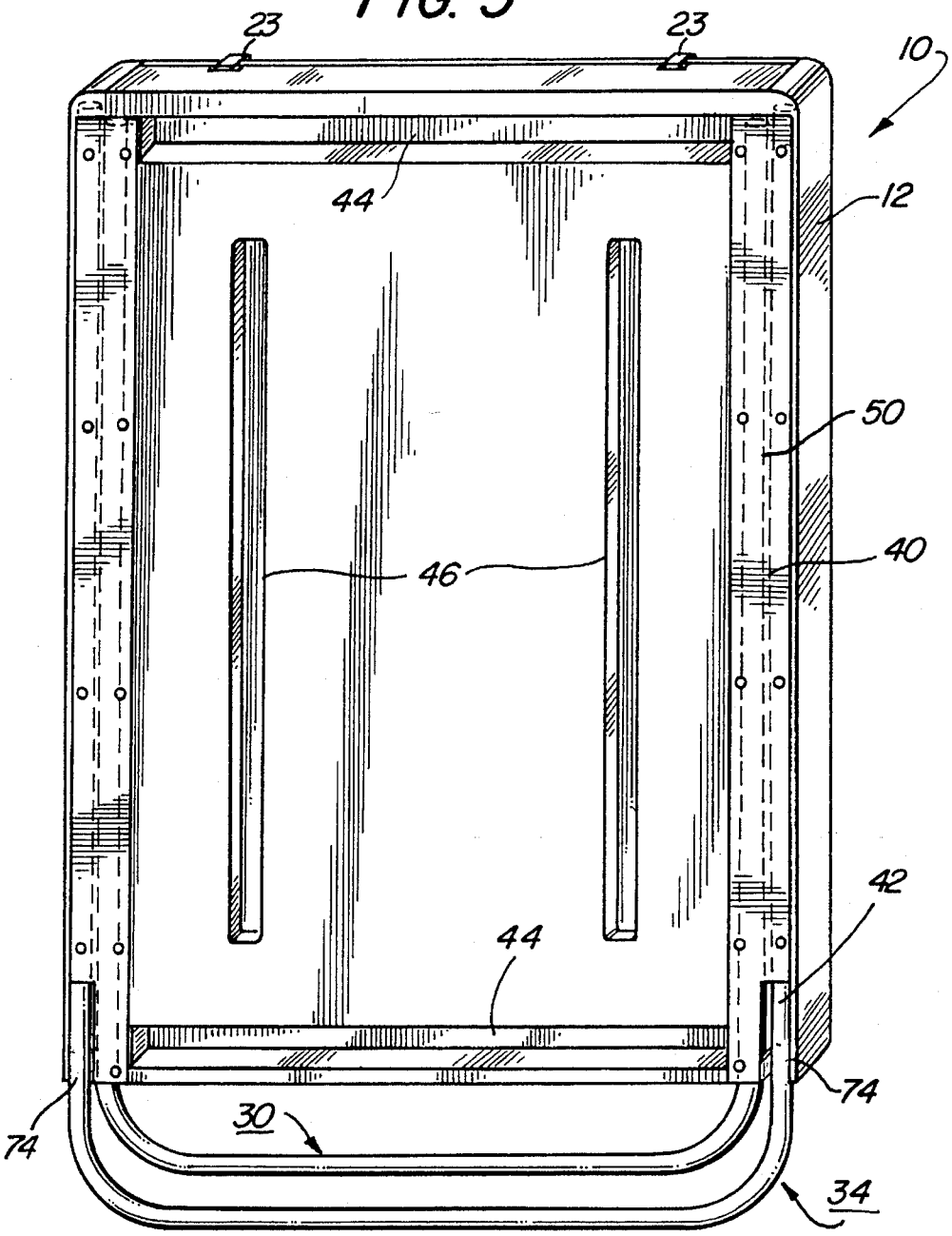
FIG.5 shows a perspective view of the rear surface of the present invention with the legs fully telescoped into the board.

FIG. 5 shows a view of the rear surface of the board 10 with the leg members 30, 34 in a collapsed position. The leg members 30, 34 can be collapsed by pivoting the rear leg member 34 towards the front leg member 30 until the leg members 30, 34 are essentially parallel. In this configuration the leg members 30, 34 can be slid towards the top of the board body 12. The leg members 30, 34 slide into the leg channels 50, recesses in the rear surface of the board body 12, which are covered by the leg cover plates 40.

Figure 6:
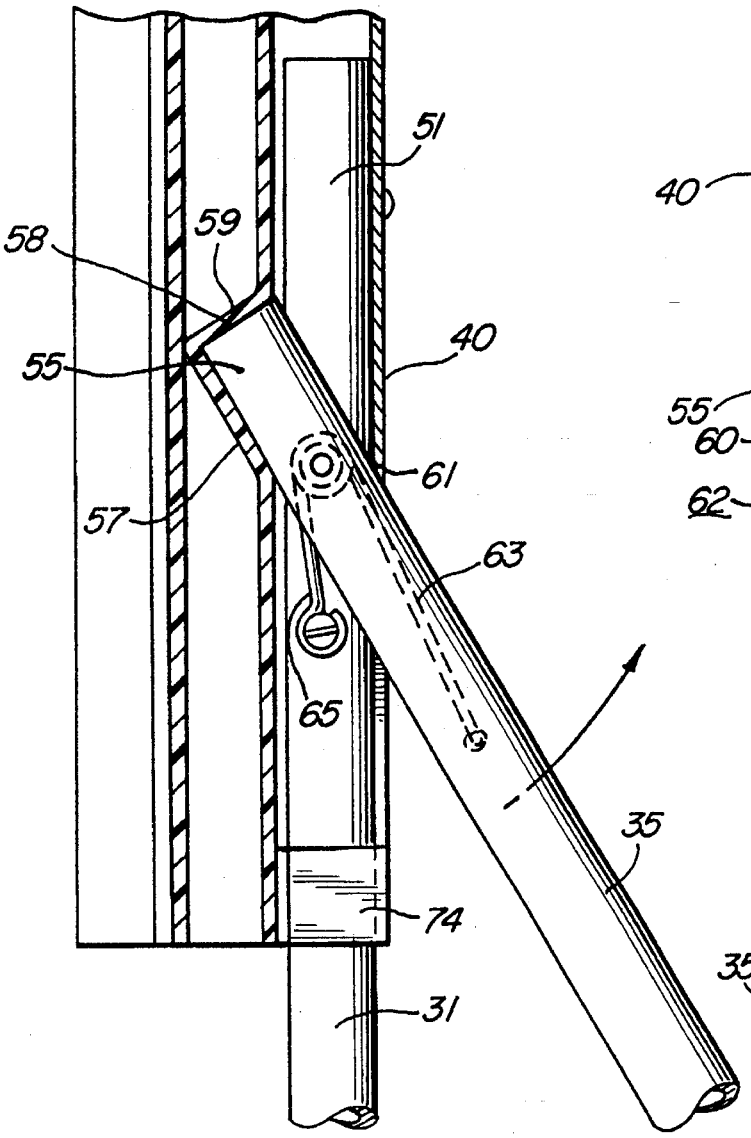
FIG. 6 is a side view of a leg assembly showing the relationship between leg members.
Figure 7:
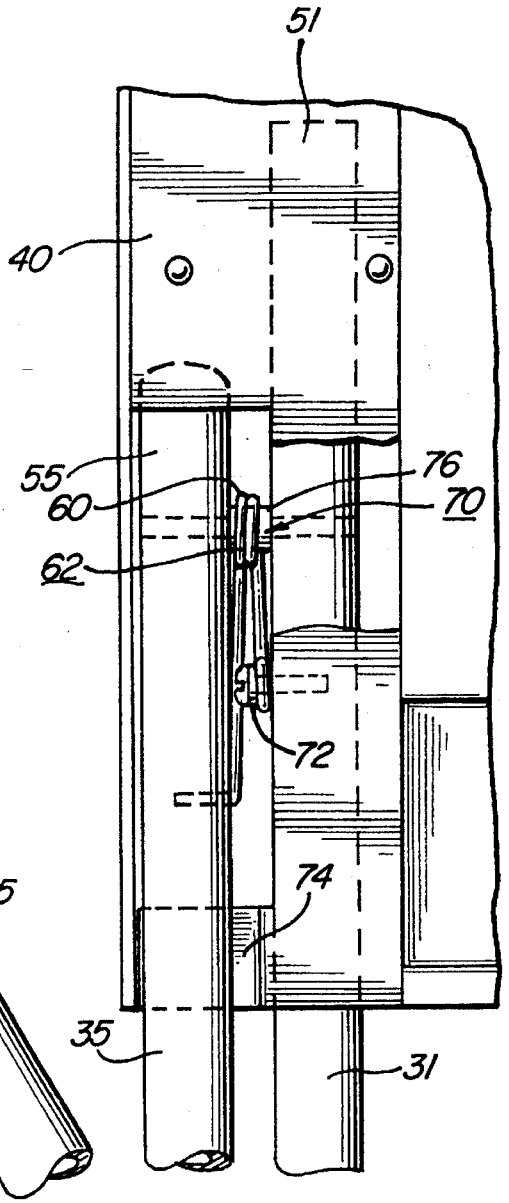
FIG. 7 is a top view of the leg assembly showing a pivot piece.

The leg members 30, 34 are actually joined to form a leg assembly. FIGS. 6 and 7 illustrate connections between the leg members 30, 34. FIG. 6 shows a side view of the leg assembly when the legs 31, 35 are extended. An upper end 51 of the front leg 31 extends a few inches beyond an upper end 55 of the rear leg 35. This extra length of the front leg 31 ensures stability since more of the leg 31 is enclosed by the leg cover 40, thereby providing a larger area for the distribution of forces caused by the weight of the board body 12 on the front leg 31. The two leg members 30, 34 are pivotally joined together a short distance below the upper end 55 of the rear leg 35. A suitably-sized hole is formed through the two legs 31, 35 at that point. As shown in FIG. 7, an axle-like pivot piece 70 is inserted through both the legs 31, 35. A midportion 76 of the pivot piece 70 is of a larger diameter so that the legs 31, 35 are spaced apart by the midportion 76.

The midportion 76 of the pivot piece 70 passes through a central spiral 60 of a torsion spring 62, thereby capturing the spring 62 between the legs 31, 35. A long leg 63 of the spring 62 is attached to the rear leg 35, while a short leg 65 is attached to the front leg 31. The spring 62 biases the leg members 30, 34 to pivot apart scissors-like. The rear member 34 is allowed to pivot to the rear of the board 10 by the cutout 42 in the leg cover plate 40 and by a V-shaped pivot depression 58 in a bottom surface of the leg channel 50 which accommodates the upper end 55 of the leg 35 as it pivots. The pivoting of the rear leg 35 is stopped at a predetermined angle by a first side 57 of the pivot depression 58 and by an edge 61 of the cutout 50. The leg cover plate 40 is designed so that the cutout edge 61 falls almost directly above the pivot depression 58 (FIG. 6). When the board 10 is leaningly supported by the rear leg member 34, a force caused by the weight of the board is primarily absorbed by a second side 59 of the pivot depression 58.

As the leg members 30, 34 are slid from the leg channels 50, the leg cover plates 40 and the bottom surface of the channels prevent the legs 31, 35 from pivoting. When the leg members 30, 34 have been extended to the optimum point, these restrictions on the rear leg member 34 are relieved by the cutouts 42 and by the pivot depressions 58, and the rear legs 35 pivot to the rear of the board 10. The front leg member 30 remains restricted and does not pivot.

A small stop 72 is screwed to the attachment of the short leg 65 of the torsion spring 62 to the front leg 31. This stop 72 interacts with a second stop 74 attached to the leg cover plate 40 to prevent the leg assembly from being completely withdrawn from the leg channels 50. The additional length of the upper ends 51 of the front legs 31 strikes upper ends of the leg channels 50 when the leg members 30, 34 are slid into the board body 12, thereby preventing the leg members 30, 34 from being inserted too far.

To reiterate, when the presentation board 10 is set up it can be easily collapsed for storage or transport. First the board 10 is placed on the floor with the rear legs 35 pointing up. The rear leg member 34 is pressed down, pivoting it to become parallel with the front leg member 30. When the rear legs 35 have been pivoted down through the cutouts 42, the leg members 30, 34 can be slid towards the top of the board 10, thereby telescoping the legs 31, 35 into the board body 12. For setup, the board 10 is placed front surface down on a floor or other supporting surface. The leg members 30, 34 are held together, and the leg members 30, 34 are pulled from the board 10. When the pivot 70 reaches the cutout 42, the rear leg member 34 will pivot out from the board body 12. When the rear legs 35 are fully pivoted, the board can be lifted to stand on its legs 31, 35.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A presentation board comprising:

a board body, substantially planar and rectangular in shape;

leg channels, lengthwise recesses in a rear surface of the body with a pivot depression in a floor of each channel near a bottom edge of the board body;

leg covers for covering the leg channels, each cover with a cutout so that a portion of each leg channel is not covered, the cutout being aligned with the pivot depression;

a leg assembly largely concealable by sliding into the leg channels, the leg assembly comprising:

a front leg member, substantially U-shaped of tubular construction, two substantially straight uprights of the front leg member constituting a pair of front legs, the front legs joined by a lower, substantially straight, portion of the front leg member;

a rear leg member, substantially U-shaped of tubular construction, two substantially straight uprights of the rear leg member constituting a pair of rear legs, the rear legs joined by a lower, substantially straight, portion of the rear leg member;

pivots for pivotally joining, side by side, the front leg member to the rear member near ends of the front legs and the rear legs; and torsion springs, held between and connected to the joined legs, for biasing the joined leg members to pivot so that their lower portions move apart when the leg assembly is slid from the leg channels, the rear legs pivoting through the cutouts with upper ends of the rear legs above the pivot moving into the pivot depressions while the front legs are held parallel to a long axis of the board body by the leg covers.

2. The presentation board of claim 1, wherein the board body has, on a front surface thereof, channels for retaining a whiteboard surface.

3. The presentation board of claim 1, wherein a flip chart pad retainer is attached to a front surface of the board body near an upper edge, the retainer comprising:

pegs of a height and diameter to accommodate holes punched in a flip chart pad, the pegs attached to the surface of the board body and spaced apart to receive and retain the flip chart pad; and a protruding grip near the upper edge of the front surface of the body board, the grip slidingly attached to the front surface of the board by the pegs which pass through slots in a rear portion of the grip so that the grip may be slid upwards to reveal the pegs for replacement of the pad or slid downward with a front face of the grip covering the pegs and locking the pad into place.

4. The presentation board of claim 3, wherein the board body bears a recess on its rear surface sized to accept the protruding grip so that the boards are readily stackable.

5. The presentation board of claim 3, wherein a whiteboard surface is slid into channels on the front surface of the board body and retained by the pegs which pass through holes near an upper edge of the whiteboard.

6. The presentation board of claim 1, wherein the board body further bears a protruding tray near a lower edge of the front surface, the tray mating with a corresponding recess on the rear surface of the body board so that the presentation boards are readily stackable.

7. A presentation board comprising:

a board body, substantially planar and rectangular in shape;

a flip chart pad retainer attached to a front surface of the board body near an upper edge, the retainer comprising:

pegs of a height and diameter to accommodate holes punched in a flip chart pad, the pegs spaced apart to receive and hold the flip chart pad; and a protruding grip near the upper edge of the front surface of the body board, the grip slidingly attached to the front surface of the board by the pegs so that the grip may be slid upwards to reveal the pegs for replacement of the pad or slid downward with a front face of the grip covering the pegs and locking the pad into place; and legs for elevating and supporting the board body.

8. The presentation board of claim 7, wherein the legs comprise a leg assembly which slides into the presentation board for storage, the leg assembly comprising:

a front leg member, substantially U-shaped of tubular construction, with two substantially straight uprights of the front leg member forming a pair of front legs joined by a lower substantially straight portion of the front leg member;

a rear leg member, substantially U-shaped of tubular construction, two substantially straight uprights of the rear leg member forming a pair of rear legs joined by a lower substantially straight portion of the rear leg member; and pivots for pivotally joining the rear leg member and the front leg member, side by side, near ends of the front legs and the rear legs; the board further comprising:

leg channels, lengthwise recesses in a rear surface of the body with a pivot depression in a floor of each channel near a bottom edge of the board body, the channels for slidably accepting the leg assembly;

leg covers for covering the leg channels, each cover with a cutout so that a portion of each leg channel is not covered, the cutout being aligned with the pivot depression; and torsion springs, held between the joined legs and connected to the joined legs, for biasing the joined leg members to pivot lower portions of the leg members apart when the leg assembly is slid from the leg channels, the rear leg member pivoting through the cutout, with upper ends of the rear leg member above the pivot moving into the pivot depressions while the front leg member remains held parallel to a long axis of the board body by the leg covers.

9. The presentation board of claim 7, wherein the board body has, on a front surface thereof, channels for retaining a whiteboard surface.

10. The presentation board of claim 9, wherein a whiteboard surface is inserted into the channels and retained by the pegs which pass through holes near an upper edge of the whiteboard surface.

11. The presentation board of claim 7, wherein the board body bears a recess on its rear surface sized to accept the protruding grip so that the boards are readily stackable.

12. The presentation board of claim 7, wherein the board body further bears a protruding tray near a lower edge of the front surface, the tray mating with a corresponding recess on the rear surface of the board body so that the presentation boards are readily stackable.

13. A presentation board comprising:

a board body;

leg channels, recesses in a rear surface of the board body, with a pivot depression in a floor of each channel near a bottom edge of the board body;

leg covers for covering the leg channels, each cover with a cutout so that a portion of each leg channel is not covered;

a leg assembly largely concealable by sliding into the leg channels, the leg assembly comprising:

two leg members, ends of which pivotally joined, side by side;

spring means, connected to the joined leg members, for biasing the joined leg members to pivot so that lower parts of the leg members move apart when the leg assembly is slid from the board body channel, a first leg member pivoting through the cutout with upper ends of the first leg member moving into the pivot depressions, while a second leg member remains held by the leg cover parallel to a long axis of the board body.

14. The presentation board of claim 13, wherein the board body has, on a front surface thereof, channels for retaining a whiteboard surface.

15. The presentation board of claim 13, wherein a flip chart pad retainer is attached to a front surface of the board body near an upper edge, the retainer comprising:

pegs of a height and diameter to accommodate holes punched in a flip chart pad, the pegs spaced apart to receive and retain the flip chart pad; and a protruding grip near the upper edge of the front surface of the body board, the grip slidingly attached to the front surface of the board so that the grip may be slid upwards to reveal the pegs for replacement of the pad or slid downward with a front face of the grip covering the pegs and locking the pad into place.

16. The presentation board of claim 15, wherein the board body bears a recess on its rear surface sized to accept the protruding grip so that the boards are readily stackable.

17. The presentation board of claim 15, wherein a whiteboard surface is slid into channels on the front surface of the board body and retained by the pegs which pass through holes near an upper edge of the whiteboard.

18. The presentation board of claim 13, wherein the board body further bears a protruding tray near a lower edge of the front surface, the tray mating with a corresponding recess on the rear surface of the body board so that the presentation boards are readily stackable.

19. A presentation board comprising:

a board body, substantially planar and rectangular in shape;

a flip chart pad retainer attached to a front surface of the board body near an upper edge, the retainer comprising:

pegs of a height and diameter to accommodate holes punched in a flip chart pad, the pegs spaced apart to receive and hold the flip chart pad; and a protruding grip near the upper edge of the front surface of the body board, the grip slidingly attached to the front surface of the board so that the grip may be slid upwards to reveal the pegs for replacement of the pad or slid downward with a front face of the grip covering the pegs and locking the pad into place; and a whiteboard surface slid into channels on the front surface of the board body and removably retained by the pegs which pass through holes near an upper edge of the whiteboard so that the whiteboard surface can be readily replaced.

20. A presentation board comprising:

a board body, substantially planar and rectangular in shape;

legs for elevating and supporting the board body, comprising a leg assembly which slides into the presentation board for storage, the leg assembly comprising:

a front leg member, substantially U-shaped of tubular construction, with two substantially straight uprights of the front leg member forming a pair of front legs joined by a lower substantially straight portion of the front leg member;

a rear leg member, substantially U-shaped of tubular construction, two substantially straight uprights of the rear leg member forming a pair of rear legs joined by a lower substantially straight portion of the rear leg member; and pivots for pivotally joining the rear leg member and the front leg member, side by side, near ends of the front legs and the rear legs;

leg channels, lengthwise recesses in a rear surface of the body with a pivot depression in a floor of each channel near a bottom edge of the board body, the channels for slidably accepting the leg assembly;

leg covers for covering the leg channels, each cover with a cutout so that a portion of each leg channel is not covered, the cutout being aligned with the pivot depression;

torsion springs connected to the joined legs for biasing the leg members to pivot lower portions of the leg members apart when the leg assembly is slid from the leg channels; and a flip chart pad retainer attached to a front surface of the board body near an upper edge, the flip chart pad retainer comprising:

pegs of a height and diameter to accommodate holes punched in a flip chart pad, the pegs spaced apart to receive and hold the flip chart pad; and a protruding grip near the upper edge of the front surface of the body board, the grip slidingly attached to the front surface of the board by the pegs so that the grip may be slid upwards to reveal the pegs for replacement of the pad or slid downward with a front face of the grip covering the pegs and locking the pad into place.

21. A presentation board comprising:

a board body, substantially planar and rectangular in shape;

a flip chart pad retainer attached to a front surface of the board body near an upper edge, the retainer comprising:

pegs of a height and diameter to accommodate holes punched in a flip chart pad, the pegs spaced apart to receive and hold the flip chart pad; and a protruding grip near the upper edge of the front surface of the body board, the grip slidingly attached to the front surface of the board by the pegs so that the grip may be slid upwards to reveal the pegs for replacement of the pad or slid downward with a front face of the grip covering the pegs and locking the pad into place; channels on a front surface of the board body;

a whiteboard surface inserted into the channels and fixed in place by the pegs which pass through holes in an edge thereof; and legs for elevating and supporting the board body.

* * * * *